United States Patent [19]

Hogarth

[11] Patent Number: 4,664,192

[45] Date of Patent: May 12, 1987

[54] CEMENTING APPARATUS AND METHODS

[75] Inventor: Peter J. M. Hogarth, St. Cyrus, Scotland

[73] Assignee: Easfind Limited, Aberdeen, Scotland

[21] Appl. No.: 659,105

[22] Filed: Oct. 9, 1984

[30] Foreign Application Priority Data

Oct. 8, 1983 [GB] United Kingdom ..... 8326959

[51] Int. Cl.[4] ..... E21S 33/16

[52] U.S. Cl. ..... 166/291; 166/154; 166/242

[58] Field of Search ..... 166/285, 291, 153, 154, 166/156, 242

[56] References Cited

U.S. PATENT DOCUMENTS

| | | | |
|---|---|---|---|
| 3,364,996 | 1/1968 | Brown | 166/156 |
| 4,190,111 | 2/1980 | Pavis | 166/242 |
| 4,250,966 | 2/1981 | Streich et al. | 166/242 |
| 4,436,151 | 3/1984 | Callihan et al. | 166/154 |
| 4,442,894 | 4/1984 | Callihan et al. | 166/156 |
| 4,469,174 | 9/1984 | Freeman | 166/285 |

FOREIGN PATENT DOCUMENTS

| | | |
|---|---|---|
| 2115860 | 9/1983 | United Kingdom . |
| 2135720 | 9/1984 | United Kingdom . |

*Primary Examiner*—James A. Leppink
*Assistant Examiner*—William P. Neuder
*Attorney, Agent, or Firm*—Seidel, Gonda, Goldhammer & Abbott

[57] ABSTRACT

In drilling a well, sections of casing are run down a borehole, preferably with a float shoe at the lower end which is equipped with a double valve enabling the casing to fill with drilling mud both while the casing is moving down and also while it is stationary. Within the casing is a baffle collar which defines a socket for a latching dart carried by a plug. The plug and dart are driven down to the collar, when the pumping of cement into the casing has been completed, by a launching dart which also closes the passageway through the plug.

12 Claims, 6 Drawing Figures

CEMENTING APPARATUS AND METHODS

FIELD OF THE INVENTION

This invention relates generally to methods of and apparatus for the drilling of wells, including both deep and shallow undersea wells. However, it is to be understood that the invention is not limited to underwater drilling.

In drilling a well, for example sub-sea, the borehole is formed and a casing is inserted to line the hole. The casing is made up of a number of cylindrical sections which are passed down the hole in sequence and which are screwed together end-to-end. As one moves down to lower depths the diameter of the casing is reduced. It is therefore the practice to run a number of lengths of casing of constant diameter into the hole, then to pump cement into the gap between the borehole wall and the outer wall of the casing to seal the structure and hold it in place, and then when this cementing operation is complete to pass further cylindrical sections of casing of reduced diameter down through the first casing section and to screw them together so that they extend downwardly from the first section. These procedural steps are then repeated with reducing diameter casing sections.

The cementing of large size casings has heretofore involved recurring problems, primarily due to the magnitude of the components involved.

SUMMARY OF THE INVENTION

It is one object of the present invention to provide apparatus for and methods of drilling wells which enable a great deal of time to be saved in carrying out the operational procedures. Time is a key factor in any well-drilling operation.

It is a further object of the present invention to provide improved methods of and apparatus for pumping the cement between the borehole wall and the outside of the casing.

It is yet a further object of the present invention to provide means within the casing whereby, when running the casing into the borehole, the fluid mud within the borehole will be able to fill up the casing, thus reducing pressure build-up within the casing as can happen if the fluid mud is prevented from filling up the casing before the casing has reached the required depth.

In accordance with the present invention there is provided apparatus for use in well drilling, comprising, in a well casing, a locking member extending from the leading end of a drive member, the drive member being in substantial sealing engagement with the casing, a socket fixed to the casing in alignment with the locking member and adapted to receive the locking member, passageway means for allowing fluid flow along the casing past the drive member, and closure means for the passageway means, the locking member and the socket being matched so that on entry of the locking member into the socket they will latch together.

The drive member is preferably a plug and may have an axial through bore forming the passageway means. This bore may co-operate with a bore through the locking member, which may be for example in the form of a latching dart. The bore through the plug may be closable by a launching dart engageable in the plug bore at the opposite end of the plug from the locking member.

The socket is preferably an internal collar within the casing, made of an easily drillable material.

The locking member preferably carries around it a spring-loaded ratchet ring which can be slightly compressed in diameter but which is biassed into its original form. The socket may have a ratchet receiver or other inward projection which on entry of the locking member into the socket forces the ratchet ring to be compressed, allowing it to move in one direction but preventing its withdrawal on returning to its original form. To ease the entry of the locking member into the socket the socket may have a chamferred surface facing the locking member.

The locking member and/or socket may carry sealing means for effectively preventing fluid flow past them when they are in latching engagement.

The invention also includes a method of drilling a well comprising the steps of running sections of casing down a borehole, at least one of said sections being provided with an internal socket, positioning a drive member with a locking member extending from its leading end within the casing above the socket, pumping cement down the casing past the drive member and through the socket, and when the pumping of cement is complete forcing a closure member down the casing into said drive member, thereby to seal the casing at the drive member and to push the drive member down the casing until the locking member engages with the socket to prevent further flow of cement in either direction.

Also in accordance with the invention there is provided a borehole casing section equipped with an internal shoe or collar which comprises an annulus of drillable material with an axial bore therethrough, and valve means provided in said axial bore, said valve means comprising a first valve which permits upward flow of fluid into the casing section through first passage means while the casing section is lowered in a borehole and which permits continued upward flow of fluid into the casing section through bypass passage means when the casing section is stationary in the borehole, and a second valve which is maintained inactive during the upward flow of said fluid but which is actuated to become a valved closure of said first passage means when cement is pumped down the casing section and to prevent backflow of cement up through said axial bore.

Preferably, the first valve comprises a displaceable captive element, such as a ball.

Preferably, the flow area provided by the bypass passage means is of the order of 50% of the flow area of the first passage means.

The second valve may be a pivotable flap valve which is brought into operation by the shearing away of at least part of said first valve.

BRIEF DESCRIPTION OF THE DRAWINGS

In order that the invention may be fully understood, a number of embodiments in accordance with the invention will now be described by way of example and with reference to the accompanying drawings, in which.

DESCRIPTION OF THE PREFERRED EMBODIMENT

Figure 1:
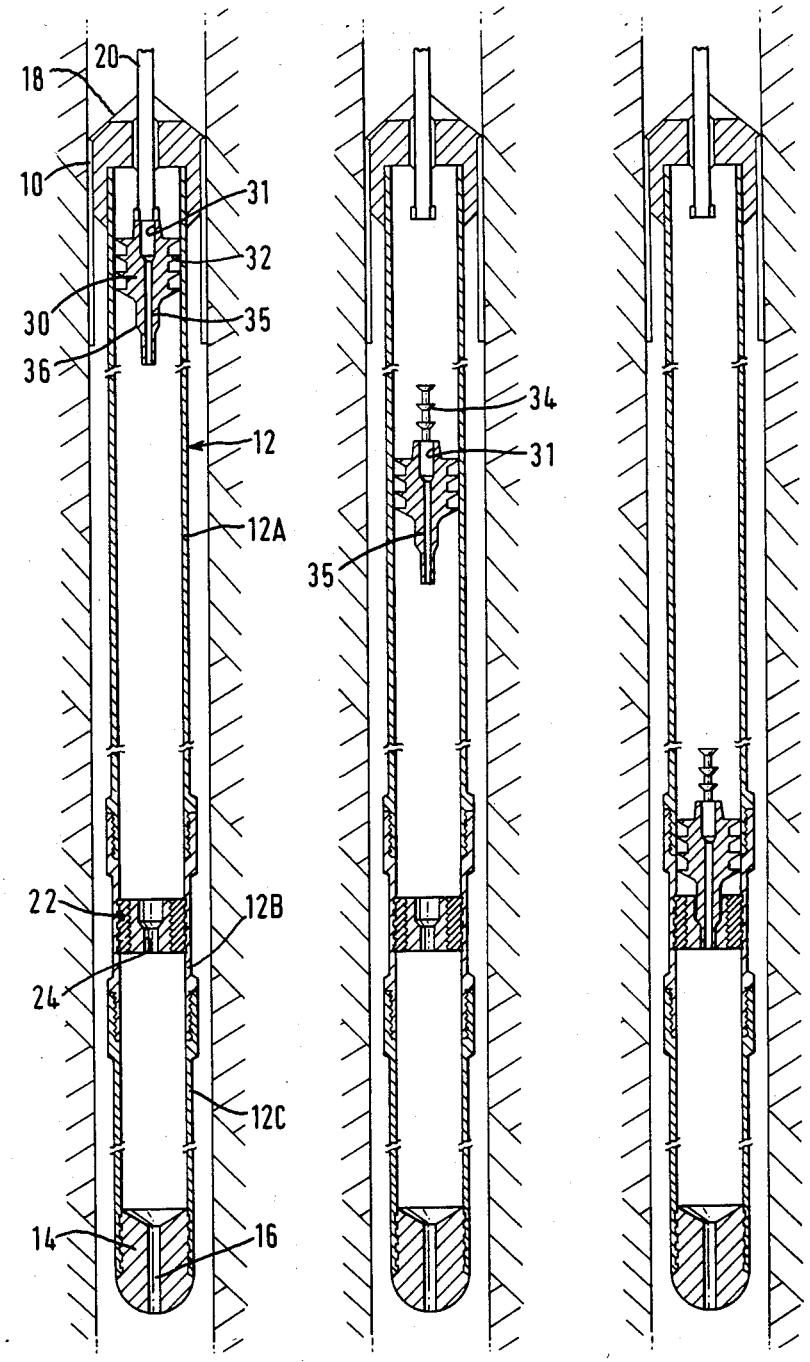
FIG. 1 illustrates, for a first embodiment of apparatus in accordance with the invention, the sequence of method steps used in carrying out the invention.

Referring first to FIG. 1, the three part-sectional views shown therein illustrate apparatus in accordance with the invention in a casing of an oil well during its insertion into the borehole. A 30 inch (760 mm) diameter section 10 of the casing has already been positioned within the borehole and cement (not shown) has been pumped between the outer wall of this casing section 10 and the wall of the borehole. A 20 inch (500 mm) diameter section 12 of casing, made up of a number of cylindrical sections 12A, 12B, 12C . . . screwed together in situ, are shown as having been passed down the borehole through and beyond the larger diameter casing section 10. This has been achieved by virtue of a guide shoe or float shoe, indicated generally at 14, located at the leading end of the lowermost cylindrical section 12C. The guide shoe 14 has a passageway 16 extending axially therethrough.

At the upper end of the 30 inch (760 mm) diameter casing 10 there is shown an installation tool 18 with a drill pipe 20 extending axially through it and into the interior of the casing.

Positioned within the casing 12, and normally adjacent to the first screw joint from the leading end of the lowermost casing section, is a cement baffle collar 22 which has an axial through bore 24. The bore 24 through the collar 22 has a narrow diameter section below a larger diameter section. At the upper end of the larger diameter section there is a circumferential shoulder which faces downwardly. This shoulder is shown more clearly at 26 in FIG. 2. The entrance to the axial bore 24 is chamferred, as indicated at 28 in FIG. 2.

When the 20 inch (500 mm) casing section 10 is in position, a plug assembly is passed into it. This plug assembly comprises a sub-sea plug 30 which has annular sealing rings 32 around it engaging the casing wall, a launching plug 34 which is dimensioned to fit into an axial through bore 31 of the sub-sea plug 30 in order to block this bore, and a ratchet dart 36 of generally complementary shape to the bore 24 in the collar 22. The through bore 31 in the sub-sea plug 30 communicates with an axial through bore 35 in the dart 36.

Figure 2:
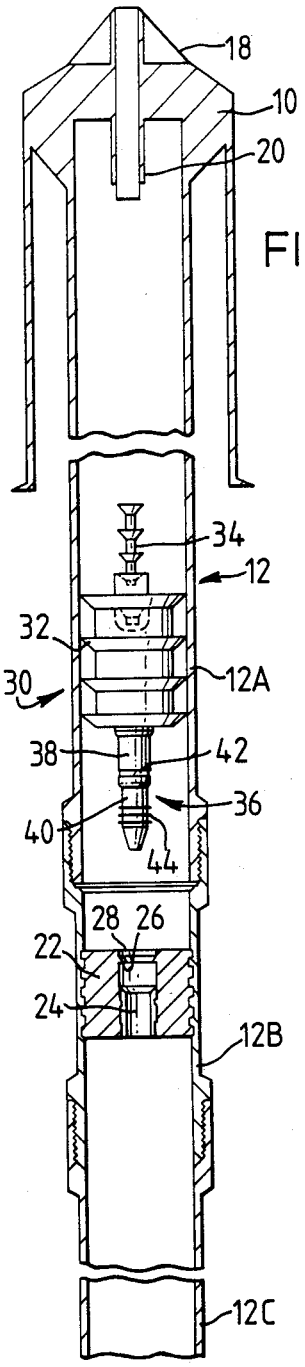
FIG. 2 is a partly schematic and partly sectional view of a portion of the casing illustrating apparatus in accordance with the invention within the casing.

As shown more clearly in FIG. 2, the latching dart 36 has a large diameter section 38 above a smaller diameter section 40. Around the larger diameter section 38 of the dart is a ratchet ring 42 which can be compressed in diameter against the body of the dart but which is spring-loaded outwardly into its original position. The smaller diameter section 40 of the dart carries three O-ring seals 44.

In use, there are three parts to the carrying out of the cementing method of the present invention. These consist of running the casing down the borehole, cementing the casing in place, and then drilling out the bottom shoe and baffle collar ready for the next smaller size of casing to be run in the borehole. In use, the shoe 14 and the baffle collar 22 are installed in the appropriate section of casing which is to be run down the borehole. The casing is then run in the normal manner. The borehole is full of drilling mud, and as the casing passes down through it the resistance of the mud and the residual bottom pressure are substantially reduced by the mud passing upwardly through the passageway 16 in the shoe 14 and into the casing interior. As will be explained in more detail hereinafter, it is important that the casing should fill up with the drilling mud as the casing is run in the borehole. This can be aided, as will be described hereinafter, by the use of a special shoe. With the mud rising at the same level both outside and inside the casing 12, there is the minimum pressure differential across the casing wall and minimum strain on the casing.

The casing is run to the last joint but one, and then the casing running tool 18 is installed, complete with the sub-sea plug 30 and latching dart 36. The plug assembly is positioned at the upper end of the 20 inch (500 mm) casing section 10. Cement is then pumped into the casing down through the drill pipe 20, through the bore 31 in the sub-sea plug 30, and through the bore 35 in the dart 36. When the pumping of cement is complete, a cement manifold turnkey valve (not shown) is opened. This releases the launching plug 34 which is forced into the upper section of the bore 31 through the sub-sea plug 30, shearing a locking pin to do so at 1700 psi, thereby to seal this bore 31. The sub-sea plug is driven down the casing, pushing the cement before it, which in turn forces the cement through the passageway 16 in the shoe 14 so that it flows outwardly and upwardly to fill the space between the borehole wall and the outside of the casing.

As the plug assembly moves downwards, so the latching dart 36 will enter the bore 24 in the baffle collar 22. It will latch into place in the collar, at which point the final cement displacement will have been completed. The latching action is effected by the ratchet ring 42 engaging the chamfer 28 and thereby being pressed inwardly, passing into the larger diameter section of the baffle collar bore 24, where the ratchet ring returns to its original shape under the spring loading action. The O-ring seals 44 engage the walls of the smaller diameter portion of the baffle collar bore 24. When the latching dart 36 is fully home it is imprisoned in the bore 24, and is prevented from withdrawal by the ratchet ring 32 engaging under the shoulder 26 at the upper rim of the baffle collar. The O-ring seals 44 are capable of resisting the same pressure from above as from below, so that there is no likelihood of pumping the sub-sea plug 30 down the casing when the plug assembly is in place. The plug and dart assembly will hold a pressure equal to that of the casing in which it is being run.

With the latching dart 36 engaged in the baffle collar 22, flow of cement ceases, including any backflow of cement. The cement is then static around the casing and is allowed to cure. When cured, the cement also fills the casing below the plug assembly and it is then necessary to drill out the interior of the casing to allow access for the next size of casing to be run in the well, i.e. a new casing section of further reduced diameter, for example $13\frac{3}{8}$ inches (340 mm). The plug assembly and baffle collar and guide shoe are all disposable. The drilling out of these components can begin if there is no pressure build-up as indicated on pressure gauges linked to the borehole. There is no loss of time at this stage, because as the cement is setting so the drilling string is made ready for the next reduced size of casing to be run in the borehole.

As mentioned above, an important feature of the present invention is the way in which the casing is permitted to fill internally as the casing is run down the borehole. The filling of the casing is dependent upon the construction of the bottom shoe 14 and of the baffle collar 22. It is desirable to arrange matters so that drilling fluid, i.e. mud, flows into the casing at a controlled rate while the casing is running in the borehole, thereby eliminating the need to fill the casing from the rig floor.

FIG. 1 shows a very simple construction of bottom shoe 14 and baffle collar 22 in which the diameter of the bore 24 in the baffle collar 22 is 4 inches (100 mm) and the diameter of the axial bore 16 through the bottom shoe 14 is 2.250 inches (57 mm).

Figure 3:
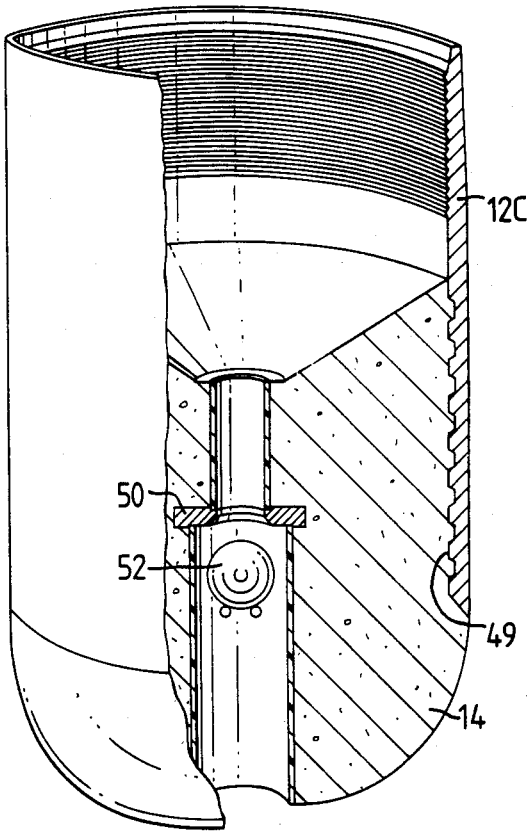
FIG. 3 illustrates one embodiment of float shoe for use at the bottom end of a section of casing.

FIG. 3 shows a modified construction of bottom shoe which again comprises a cement filling. This is here indicated at 14 and the section of the casing within which it is set is indicated at 12C. It will be noted that the internal wall surface of the leading end of this section 12C of the casing is provided with a grooved structure 49 to enhance the bonding or keying of the cement to the casing wall. The float shoe shown in FIG. 3 has only one inner metallic part, this being an aluminium sealing pressure plate 50. This pressure plate 50 provides an upper seat for a ball valve, the ball 52 of which is made of a high grade plastics material. The lower seat for the ball 52 is provided by pins set within the axial through bore. One advantage of the construction shown in FIG. 3 is that this shoe can be drilled out very rapidly at the end of a cementing operation.

Figure 4:
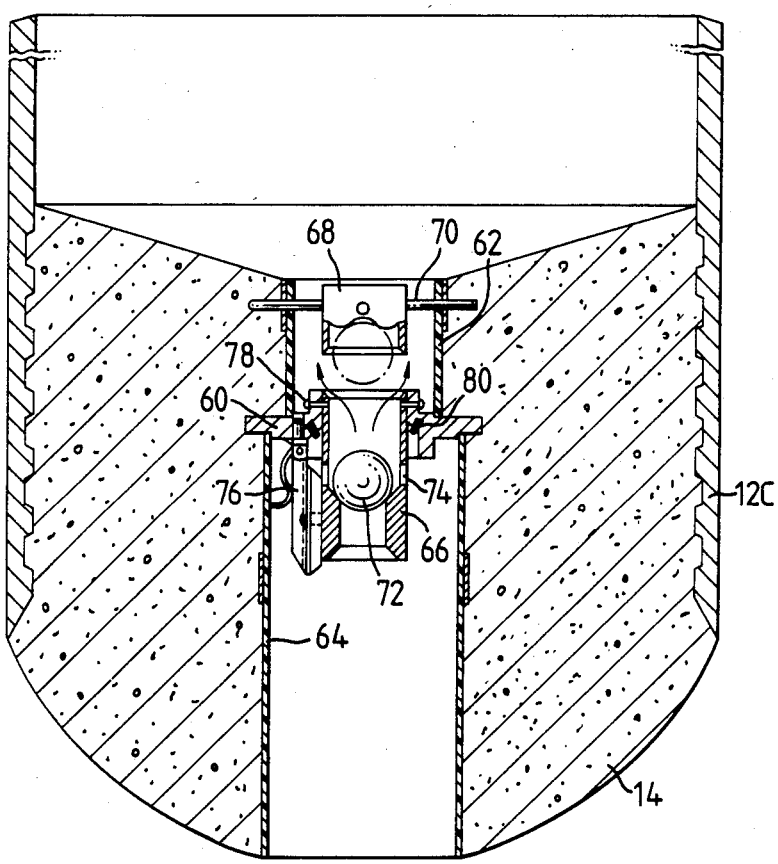
FIG. 4 shows an alternative preferred embodiment of guide shoe.
Figure 5:
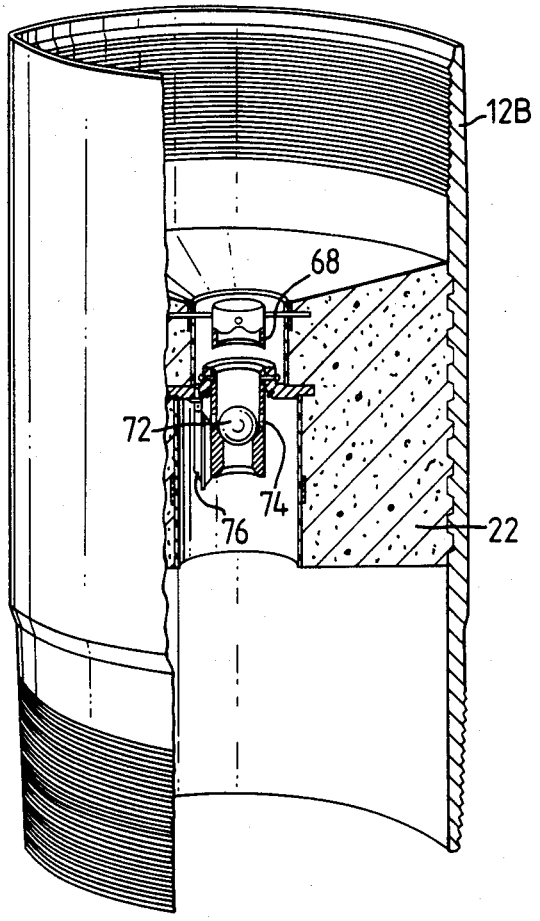
FIG. 5 shows embodiment of collar for use within the casing, the structure being analogous to that of the shoe shown in FIG. 4; and, FIG. 6 shows an alternative embodiment of collar for use within the casing.
Figure 6:
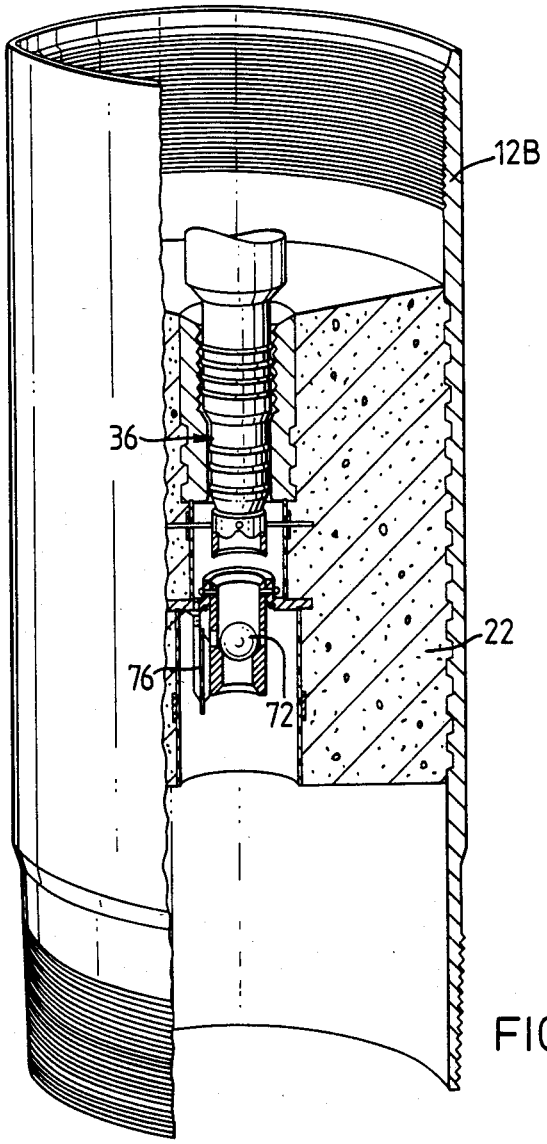

FIGS. 4 to 6 illustrate an important feature of the invention, namely various types of float shoe and collar which have the ability to permit the mud to fill up the casing as the casing is run in the borehole, to permit cement to be pumped rapidly down through the shoe or collar, and to prevent back-flow of cement up through the shoe or collar. This is achieved basically by the use of a displaceable captive element within the shoe or collar, coupled with suitable valve means.

FIG. 4 shows a preferred embodiment of cement float shoe 14. This is especially appropriate for larger diameter casings, i.e. from 30 inch (760 mm) to 16 inch (405 mm). The self-fill valve mechanism here comprises an aluminium plate 60 embedded within the cement shoe. Above the aluminium plate 60 there is a cylindrical PVC pipe 62, and below the aluminium plate a larger diameter cylindrical PVC pipe 64. An aluminium seal assembly 66 is mounted within the bore and cooperates with an aluminium sleeve 68. This sleeve 68 is held in place by a brass pin 70. A ball 72 which is made of rubber with a PVC core is movable as a captive element within the sleeve between a lower position as shown in the drawing and an upper position as indicated by broken lines. Bypass ports 74 are formed in the wall of the sleeve, for example three ports spaced circumferentially 120° apart. An aluminium flap valve assembly 76 is provided adjacent to the sleeve and is mounted for pivotal movement. Shear pins are indicated at 78. A circumferential rubber seal is provided adjacent to the aluminium plate 60 as indicated at 80.

The fill-up flow rate in a 2.25 inch (57 mm) bore inner sleeve 68, within a 20 inch (500 mm) casing will be 12 to 16 seconds per meter of pipe. The aluminium flap valve assembly 76 will hold back pressure equal to that of the casing in which it is being run. The bypass flow area 74 is preferably formed by a plurality of holes, for example three holes, which can be made to any desired diameter. Preferably, the combined cross-sectional flow area of the bypass ports 74 is one half the cross-sectional flow area of the inner sleeve bore. When fluid passing down the casing contacts the ball 72 at the bottom of the sleeve, the fluid is angled out horizontally, from its downward vertical movement. This will create a piston effect and still enables the cement to be pumped out. This is recommended for very deep wells. The bypass ports allow movement of the fluid column in the casing, thus preventing the filling up of the casing with the drilling mud from stopping before the required depth has been reached in the borehole. The bypass clearance can easily be overcome by pumping cement through the drill pipe at approximately 4 to 6 BPM for 50% bypass and 8 to 10 BPM for 100% bypass.

When running the casing, the ball 72 is pushed to the upper broken-line position. In that position drilling mud can flow into the casing through the sleeve 68. When movement of that casing section stops, the ball 72 drops to the bottom of the inner sleeve. However, the bypass ports 74 will still allow flow of the mud into the casing to reduce any pressure build-up.

In the cementing operation, when the casing has reached the required depth, a bottom rubber cement plug is placed in the top end of the casing string and is pumped down the casing until it reached the baffle collar. When cement is pumped down into the casing the inner sleeves in the baffle collar and in the float shoe, i.e. sleeve 68, will shear out by shearing of the pins 78. The seal assembly 66 drops away and the flap valve 76 then pivots upwards through 90° into its operational position in which a peripheral chamfered surface of the flap valve engages with the rubber seal 80. A top cement plug is then pumped down the inside of the casing. The pressure needed to do this will cause the bottom cement plug to open up as this plug has a rubber diaphragm in it. This helps to keep the cement and drilling mud apart. Additionally, the top plug serves to wipe the inside of the casing clean as it passes down it.

FIG. 5 shows the same structural principles embodied in the shoe of FIG. 4 applied also to the baffle collar 22 within the casing section 12B.

FIG. 6 shows the engagement of the latching dart 36 in the baffle collar 22, the collar being equipped as in FIG. 5. Here the latching dart 36 is provided with a two-stage taper to give a better centering action when it is being stabbed into the collar. In this embodiment the latching dart 36 can be screwed out of its latching position. However, it has the same ability to self-fill when running in the borehole.

I claim:

1. Apparatus for cementing a well borehole comprising, in a well casing, a locking member extending from the leading end of a drive member, the drive member being in substantially sealing engagement with the casing, a socket of drillable material fixed to a section of casing in alignment with the locking member and adapted to receive the locking member, the locking member and the socket being matched so that on entry of the locking member into the socket they will latch together, passageway means for allowing fluid flow through the casing, closure means for the passageway means, and a shoe below the socket and at the bottom of the lower most casing section, the shoe comprising an annulus of drillable material with a passageway therethrough, the shoe being provided in its passageway with valve means for permitting the movement of drilling fluid into the casing when the sections of casing are being run and when the sections are stationary, the valve means including a floating captive element displaceable by the drilling fluid to an upper position when the casing section is being lowered and a lower position when the casing section stops.

2. Apparatus as claimed in claim 1, in which the drive member is a plug and said passageway means comprises a bore through the plug.

3. Apparatus as claimed in claim 2, in which said bore communicates with a second bore through the locking member.

4. Apparatus as claimed in claim 1, in which the locking member is a latching dart.

5. Apparatus as claimed in claim 1, in which the closure means comprises a dart engageable in a bore at the end of the drive member opposite to said locking member.

6. Apparatus as claimed in claim 1, in which the locking member is provided with a circumferential spring-loaded ratchet ring which can be compressed slightly in diameter, and the socket includes projecting means which on entry of the locking member into the socket forces the ratchet ring to be compressed but thereafter prevents its withdrawal.

7. Apparatus as claimed in claim 1, in which the socket has an upper relatively large diameter bore and a lower relatively small diameter bore, with a circumferential inwardly projecting shoulder at the upper end of the upper bore.

8. A borehole casing section equipped with an internal shoe which comprises an annulus of drillable material with an axial bore therethrough, and valve means provided in said axial bore, said valve means comprising a first valve which permits upward flow of fluid into the casing section through first passage means while the casing section is being lowered in a borehole and which permits a reduced flow of fluid into the casing section through bypass passage means when the casing section is stationary in the borehole, said first valve comprising a captive valve element displaceable by said fluid to an upper position when the casing section is being lowered and a lower position when the casing section steps, and a second valve which is maintained inactive during the upward flow of said fluid but which is actuated to become a valved closure of said first passage means when cement is pumped down the casing section and to prevent backflow of cement up through said axial bore.

9. A borehole casing section as claimed in claim 8, in which the flow area provided by said bypass passage means is of the order of 50% of the flow area of said first passage means.

10. A borehole casing section as claimed in claim 8, in which the second valve comprises a pivotable flap valve.

11. A borehole casing section as claimed in claim 8, in which said captive valve element is a ball arranged to float within a tubular sleeve between said lower position adjacent to the second valve and said upper position spaced above the second valve.

12. A method of cementing a well borehole comprising the steps of running sections of casings down a borehole, at least one of said sections being provided with an internal socket, permitting the interior of the casing to fill with drilling fluid as the sections of casing are run down the borehole, movement of the drilling fluid into the casing both when the sections are being run and when the sections are stationary being permitted by a valve which includes a displaceable floating captive element displaceable by said fluid to an upper position when the casing section is being lowered and a lower position when the casing section stops, positioning a drive member with a locking member extending from its leading end within the casing above the socket, pumping cement down the casing through the drive member and through the socket, and when the pumping of cement is complete forcing a closure member down the casing into said drive member, thereby to seal the casing at the drive member and to push the drive member down the casing until the locking member engages with the socket to prevent further flow of cement in either direction.

* * * * *